US012486673B2

(12) United States Patent
Anisic

(10) Patent No.: US 12,486,673 B2
(45) Date of Patent: Dec. 2, 2025

(54) CLIP FASTENING BRACKET AND PLANAR CONSTRUCTION EQUIPPED THEREWITH

(71) Applicant: Antal Anisic, Wein (AT)

(72) Inventor: Antal Anisic, Wein (AT)

( * ) Notice: Subject to any disclaimer, the term of this patent is extended or adjusted under 35 U.S.C. 154(b) by 219 days.

(21) Appl. No.: 18/557,450

(22) PCT Filed: Apr. 28, 2022

(86) PCT No.: PCT/AT2022/060148

§ 371 (c)(1),
(2) Date: Oct. 26, 2023

(87) PCT Pub. No.: WO2022/226570

PCT Pub. Date: Nov. 3, 2022

(65) Prior Publication Data

US 2024/0218674 A1 Jul. 4, 2024

(30) Foreign Application Priority Data

Apr. 28, 2021 (AT) ..... 50317/2021

(51) Int. Cl.
*E04F 15/02* (2006.01)

(52) U.S. Cl.
CPC .. *E04F 15/02044* (2013.01); *E04F 15/02183* (2013.01); *E04F 2015/02094* (2013.01); *E04F 2015/02122* (2013.01)

(58) Field of Classification Search
CPC ..... E04F 15/02044; E04F 15/02183; E04F 2015/02094; E04F 2015/02122
See application file for complete search history.

(56) References Cited

U.S. PATENT DOCUMENTS 8,146,303 B2 * 4/2012 Gibson ..... E04B 5/12 52/489.1
9,850,667 B2 * 12/2017 Engstrom ..... E04F 15/02044
2013/0025228 A1 1/2013 Kilgore

FOREIGN PATENT DOCUMENTS

DE 202009007507 U1 * 9/2009 ..... E04F 15/04
EP 3090850 11/2016
KR 101683268 12/2016

(Continued)

OTHER PUBLICATIONS

International Search Report dated Aug. 11, 2022 for international patent application No. PCT/AT2022/060148.

(Continued)

*Primary Examiner* — Andrew J Triggs
(74) *Attorney, Agent, or Firm* — Husch Blackwell LLP

(57) ABSTRACT

A clip clamp for attaching boards or planks with longitudinal grooves on their edges to beams in a substructure or supporting structure that also have longitudinal grooves on both sides, without the need for screws or nails, to create flat structures such as decks, wall coverings, fences, billboards, etc., includes a squared C-shaped profile forming the base, with a rectangular middle plate, from opposing parallel edges of which two side-plates extend downward at a right angle, each of which have lip elements at their edges that engage in the grooves on the beams, while on the other side of the middle plate, two board clamps extend in the other direction, at a right angle to the side plates, which have lips facing away from one another on their upper edges that fit into the grooves in the boards.

15 Claims, 4 Drawing Sheets

(56) References Cited

FOREIGN PATENT DOCUMENTS

| | | | | | |
|---|---|---|---|---|---|
| KR | 101789158 | B1 * | 10/2017 | ..... | E04F 15/02044 |
| WO | WO-2006011173 | A1 * | 2/2006 | ..... | E04F 15/02044 |
| WO | 2015170205 | | 11/2015 | | |
| WO | 2017034455 | A1 | 3/2017 | | |

OTHER PUBLICATIONS

Machine translation of DE202009007507.
Machine translation of KR101683268.
Machine translation of EP3090850.
International Preliminary Report on Patentability dated Oct. 24, 2023 for International Patent Application No. PCT/AT2022/060148.

* cited by examiner

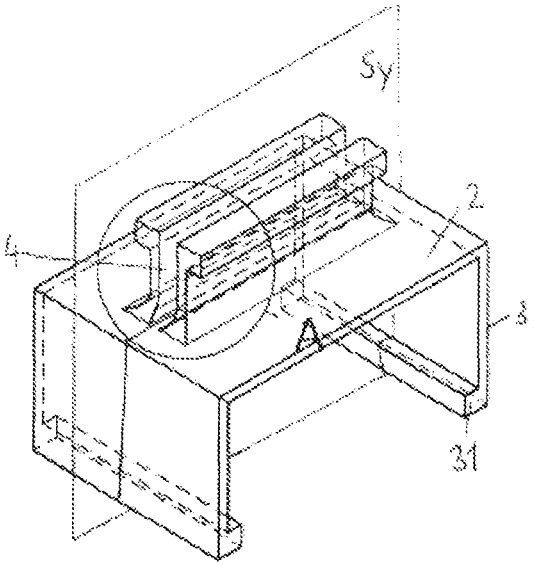
Fig. 7
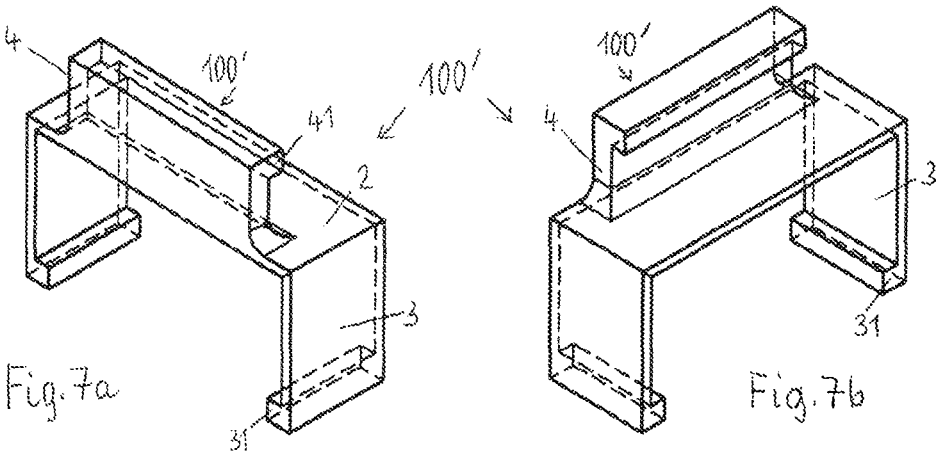
Fig. 7a
Fig. 7b

CLIP FASTENING BRACKET AND PLANAR CONSTRUCTION EQUIPPED THEREWITH

CROSS REFERENCES

This application is a U.S. National Phase Application of International Application No. PCT/AT2022/060148 filed on 28 Apr. 2022, which claims priority to Austrian Application No. A503172021 filed on 28 Apr. 2021, the disclosures of each of which are hereby incorporated by reference herein in their entireties.

TECHNICAL FIELD

The present disclosure relates to attachment of boards or planks to beams in a substructure or supporting structure and, more particularly, to fasteners for such attachment.

BACKGROUND

There are already various means for attaching boards such as decking boards or planks to substructure beams without screws or nails, which have been disclosed specifically in the following priority documents:

Documents KR 101683268 B1, EP 3090850 A1, US 2013025228 A1, WO 2006011173 A1, and WO 2015170205 A1 disclose one-piece fasteners for decking boards, with which the boards can be secured to a substructure without screws. This is accomplished in the first four documents with spring-loaded tabs that extend downward from the fastener and clip onto the substructure, and tabs that extend upward, which snap into grooves or recesses in the boards.

In WO-A1, instead of clipping the fasteners onto the beams, they are slid onto them.

According to KR-B1, the boards are attached to the substructure without any spacing between them, and the decking clips made of metal entirely encompass the substructure beams.

This means that it is difficult to remove the individual boards from the decking clips, because it is impossible to get between the boards, it is impossible to work on the wood forming the boards, and there must be a spacing between beams forming the substructure and the floor or ground underneath the decking, which makes it difficult or impossible to attach the decking clips at certain locations on the beams.

Although the decking clips disclosed in EP-A1 fit into a groove in the support beams used for the substructure with tongues, these tongues are designed such that the boards are basically attached to one another without any spacing therebetween, such that here as well, there is no space between the boards making it possible to work on them and reach in between the boards to easily remove individual boards from the structure.

WO-A1 discloses a decking clip containing not just two, but four tongues that fit into the boards, which have a barbed structure that engages in multiple grooves in the boards. The decking clip in this document also surrounds the beams used for the substructure. The boards are not spaced apart here either (see FIG. 10), and the engagement of the barbed structure in numerous different grooves in the boards makes it difficult to remove the individual boards from the structure if it is necessary to do any repair work underneath the deck.

SUMMARY

The object of the present disclosure is a novel clip clamp such as that described above, which is characterized in that it is made of an elastic, resilient material, in particular a polymer, preferably polyethylene terephthalate, forming a single, integrated piece, the elements that fit into the grooves in the support beams on the side plates and the elements that fit into the grooves in the boards on the plates forming the board clamps each form lips with a substantially square profile, in which the lips on the side plates and the lips on the board clamps are at a right angle to one another, when placing each board on the beams at a right angle thereto, the clip clamps can be pushed onto the beams by spreading the side plates apart, until their lips snap into the two longitudinal grooves therein to obtain a substantially form-fitting connection, each of the boards can then be put in place by bending the board clamp outward until the lip thereon fits into the groove in the board, and then bending back the adjacent board clamp on the beam, until the lip thereon snaps into the opposite longitudinal groove on the board, forming a substantially form-fitting connection thereto.

In a slight variation on the structure of the novel clip clamp described above, claim 2 describes a clip clamp that has a middle plate in the form of a parallelogram instead of a rectangle. This clip clamp is used to place boards on the substructure of the deck, etc. at a diagonal angle thereto.

The novel clip is intended for fastening boards to substructures or support structures. The clip basically has a lower part that is attached to the support structure and an upper part that holds the boards in place.

The lower part has a substantially C-shaped profile, on which the side plates that extend downward when the clip is in place have tongue elements, or lips that fit into grooves in the beams forming the support structure. There are then two board clamps formed on the upper surface of the base element forming the lower part, which extend upward to form the upper part, and which run at 90° or at an acute angle of no more than 45° to the side plates forming the lower part, which are at a spacing to one another, such that when the boards are put in place, there is a spacing between them as well. The board clamps also have tongue elements facing away from one another, such that they engage in the grooves in the sides of adjacent boards.

The product obtained with the present disclosure is a one-piece clip that functions on the basis of the tongue and groove concept. What is important is that the tongues are placed on the edges of the grooves under tension. All the novel product requires is a substructure with support beams that have grooves on both sides, and boards such as decking boards that also have grooves on both sides. The product is flexible enough that it spreads apart when pushing it onto the beams forming the substructure, and then resumes its original shape when it snaps into the grooves. The tongues can then be removed from the grooves with just a little effort.

This results in a sturdy deck, for example, that can be easily assembled. It is also easy to quickly access the substructure or ground below the deck after it has been assembled and put to use.

Boards that have already been put in place anywhere in the deck can be easily removed to access any installation below it, such as an LED lighting system, etc. or to be able to get at items that may have dropped between the cracks. The difference to decks assembled with screws or nails is that these must be completely removed. It is substantially easier to remove individual boards in a deck made using the novel clip clamps because of the spacing between the tongue plates that clamp into the boards.

It is advantageous with regard to removing individual boards in a deck when the board clamps, i.e., the board-clamping plates, are at least 3 mm apart from one another.

This results in a spacing of at least 4 or 5 mm between the boards.

It may also be beneficial if the lower region between the two adjacent board clamps or board-clamping plates is squared off, or they meet in a V.

With regard to installing the boards on the support structure, it is also preferred that the edges of the lips that fit into the grooves facing the middle plate on both side plates are rounded.

It may also be beneficial if the edges of the lips that fit into the grooves on the board clamps facing the middle plate and potentially the outer edges of the lips in the boards are rounded.

Lastly, there are also, advantageously, "half-clip clamps" for fastening the boards on the outer sides of the overall structure, which can be obtained by slicing the clip clamp according to the claims 1 to 6 smoothly down the middle, between the plates forming the two board clamps, along the plane of symmetry.

As mentioned above, the present disclosure also relates to a structure according to claims 7 to 15 that can be built using the novel clip clamps.

In accordance with a slight variation on the flat structure described above, the middle plate of the clip clamps can be a "slanted" parallelogram instead of a rectangle, with which the boards can be placed at an angle ranging from 450 to less than 90°, i.e., "diagonally" to the parallel beams forming the substructure.

The substantial advantages of the present disclosure are in particular the following:

As a result of the inventive design of the clips, the boards forming a deck are anchored to the substructure at a spacing to one another of, e.g., 5 mm. This makes it possible to "work on" the wood, in particular outdoors, when the boards have weathered, without any restrictions.

According to the present disclosure, the lip elements on the clip clamps can be readily snapped into the grooves on the sides of the boards, which are visible to the installer, instead of into the bottoms of the boards, which cannot be seen during installation, which would thus make it substantially more difficult and require more time.

The material from which the clips are made is selected such that it is elastic enough that it will not be damaged when removing individual boards, but is sturdy enough that it can exert enough tension to secure the boards firmly in place.

The boards can be easily removed by first exerting a horizontal force on one side of the board and pushing downward on the other side, such that the board can then be pulled upward at the first side, after the tongue has been released from the groove, and then released at the other side by pulling it away from the opposite tongue.

This particularly simple removal of the boards from the structure is not possible with the decking clips from the prior art.

It should be emphasized that the difference between the clips according to the present disclosure and those from the prior art is that none of those from the prior art allow for an arbitrary board to be replaced, i.e., it is not possible to replace a damaged board with a new one, while leaving the rest of the structure intact. This is otherwise only possible with the boards that are held from the bottom with the clips disclosed in KR-B1 by applying "extreme force," which can then result in damage to at least the clips underneath the board that is being removed.

It is also possible to create a deck of practically any shape using the clip clamps according to the present disclosure, because all three of the components, the support structure, clip clamps, and boards are simple can be tailored to a specific design.

According to one embodiment of the novel clip clamps, which simplifies the placement of the boards on the support structure in particular, at least the edges facing the middle plate on the lips on the two side plates that fit into the grooves are rounded.

With regard to saving time and labor, it is advantageous when the edges of the lips facing the middle plate on the board clamps that fit into the grooves, and potentially the outer edges thereof, are also rounded.

According to the present disclosure, there is also a special design of the novel clip clamp for the boards at the edges of the novel decking/support beam structure, which forms a half-clip clamp for securing the boards on each side of the flat structure that is obtained by smoothly "halving" a clip clamp according to the present disclosure along the plane of symmetry in the direction of the plates forming the two board clamps extending upward from the middle plate.

The present disclosure also relates to a flat structure built using the novel clip clamps according to the features in claim 8. Advantageous embodiments of the structure are obtained with the features of claims 9 to 14.

The present disclosure also relates to a method for building a flat structure according to claim 15.

These and other aspects are merely illustrative of the innumerable aspects associated with the present disclosure and should not be deemed as limiting in any manner. These and other aspects, features, and advantages of the present disclosure will become apparent from the following detailed description when taken in conjunction with the referenced drawings.

BRIEF DESCRIPTION OF THE DRAWINGS

Reference is now made more particularly to the drawings, which illustrate the best presently known mode of carrying out the present disclosure and wherein similar reference characters indicate the same parts throughout the views.

FIGS. 1 and 1*a* show a clip clamp according to an embodiment of the present disclosure and a detail thereof, diagonally from above;

FIG. 7 shows the plane of symmetry through a clip clamp according to an embodiment of the present disclosure; and FIGS. 7*a* and 7*b* each show a half-clip clamp for securing the boards on the edges of a deck, diagonally from above, according to an embodiment of the present disclosure.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

In the following detailed description numerous specific details are set forth in order to provide a thorough understanding of the present disclosure. However, it will be understood by those skilled in the art that the present disclosure may be practiced without these specific details. For example, the present disclosure is not limited in scope to the particular type of industry application depicted in the figures. In other instances, well-known methods, procedures, and components have not been described in detail so as not to obscure the present disclosure.

The headings and sub-headings used herein are intended only for general organization of topics within the present disclosure and are not intended to limit the disclosure of the technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

Figure 1:
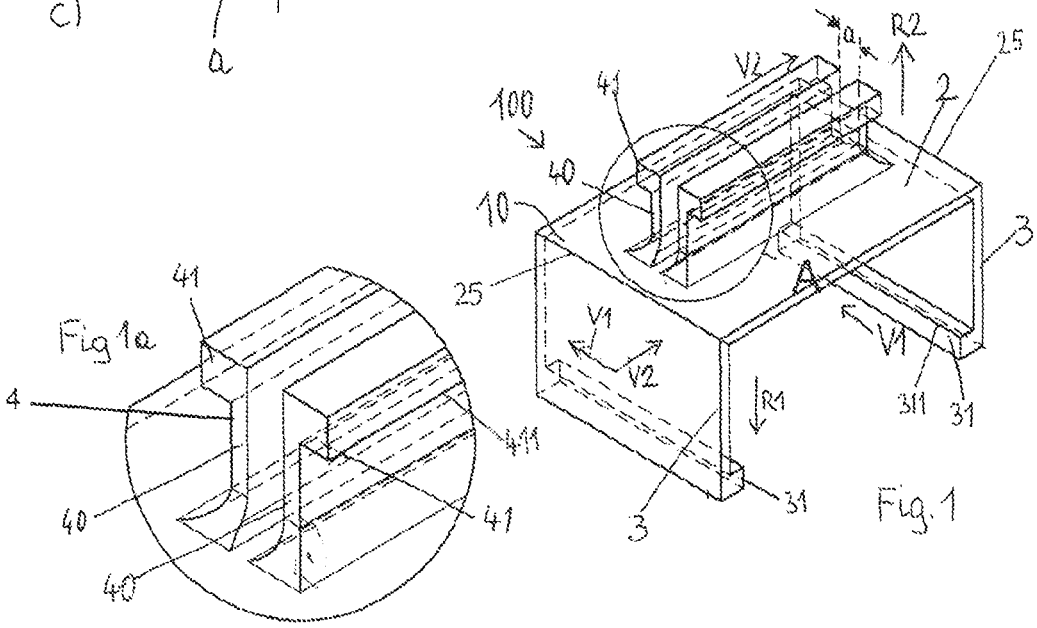

FIG. 1 illustrates one embodiment of a clip clamp 100 according to an embodiment of the present disclosure. The clip clamp 100 shown in FIG. 1 has a squared C-shaped profile 10 with a rectangular middle plate 2, from the two parallel side edges 25 of which two parallel side plates 3 extend downward in the direction R1, from which lips 31 that fit into grooves extend inward toward one another at the ends 35 thereof with a rectangular cross section, which are parallel to one another in the direction V1.

Two board clamps 4 extend upward from the middle plate 2 in the direction R2, with lips 41 that fit into grooves on the ends of the two parallel board-clamping plates 40 that are at least 3 mm apart from one another in the direction a facing away from one another, which extend at a right angle to the lengthwise direction V1 of the lips 21, in the direction V2.

It is clear from the detail shown in FIG. 1*a* that the board-clamping plates 40 transition to the middle plate 2 with rounded corners at the bottom, where they meet the middle plate.

Figure 2:
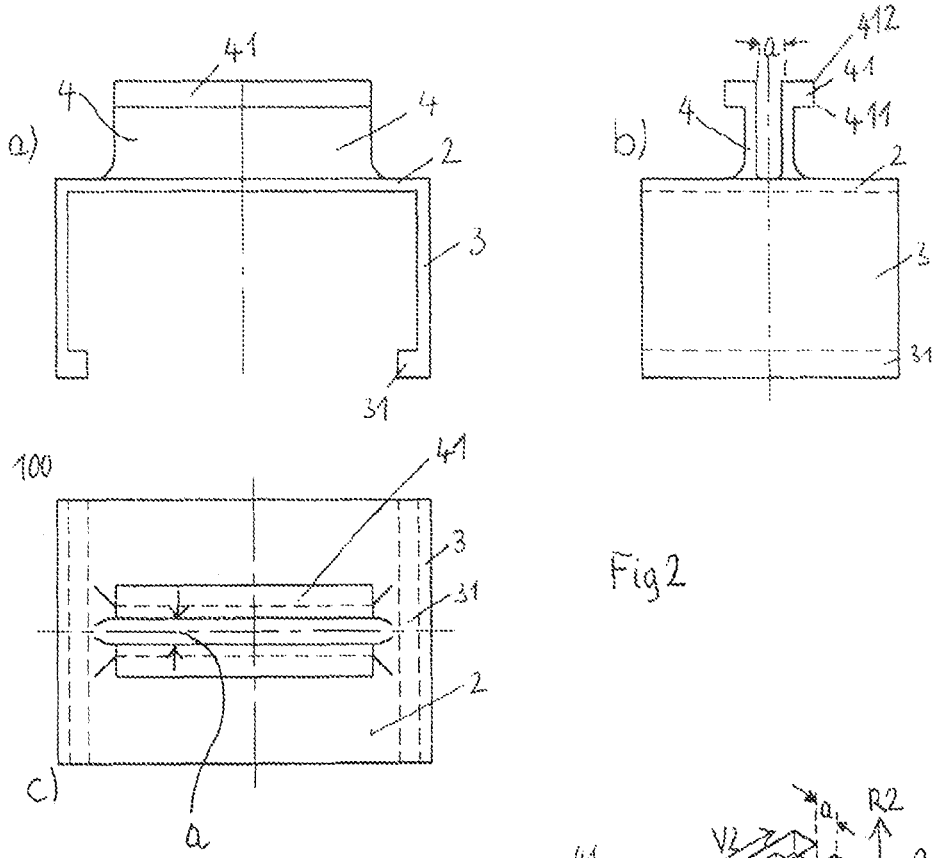
FIGS. 2*a* to 2*c* show the clip clamp of FIGS. 1 and 1*a* from the front, the side, and from above.

FIGS. 2*a* to 2*c*, in which the novel clip clamp 100 is shown from three perspectives, clearly show in detail—with otherwise the same reference symbols—the spacing a between the two clamping plates responsible for ensuring a certain spacing between adjacent boards 6 clipped in place on a support beam 5 in the support structure.

Figure 4:
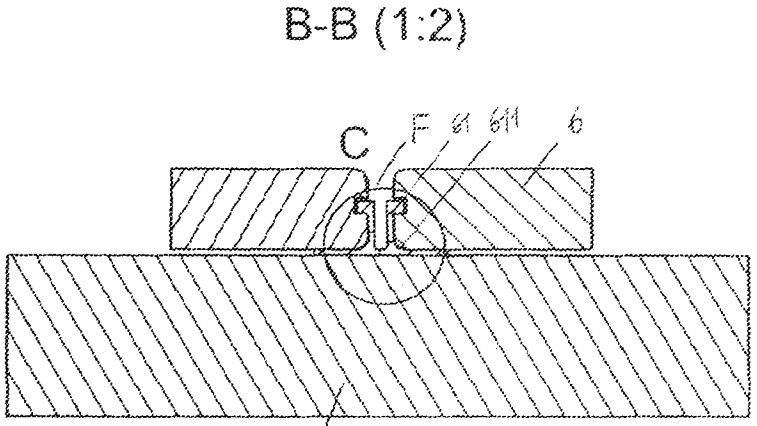
FIG. 4 shows a sectional view through two boards spaced apart by two board-clamping plates according to an embodiment of the present disclosure.
Figure 4A:
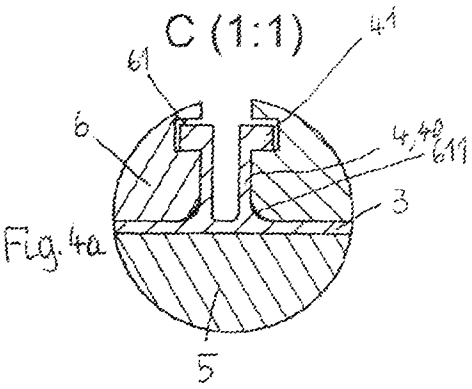
FIG. 4*a* shows a detail of two boards clipped in according to an embodiment of the present disclosure.
Figure 3:
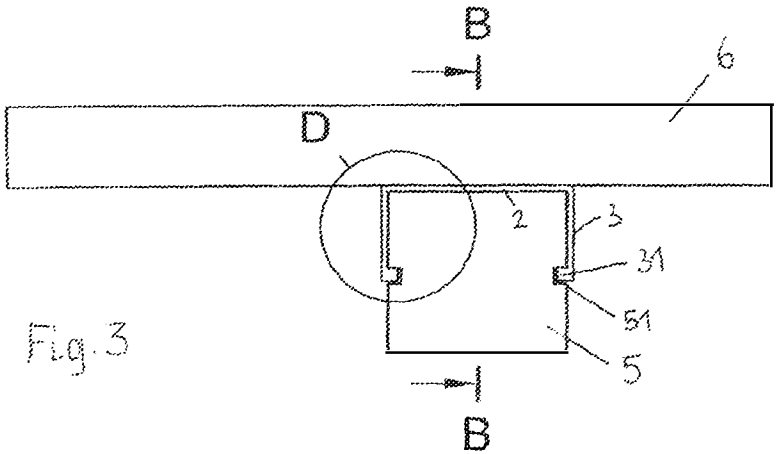
FIG. 3 shows a side view of one of the boards secured to the support structure by a clip clamp snapped into the grooves in a support beam according to an embodiment of the present disclosure.
Figure 3A:
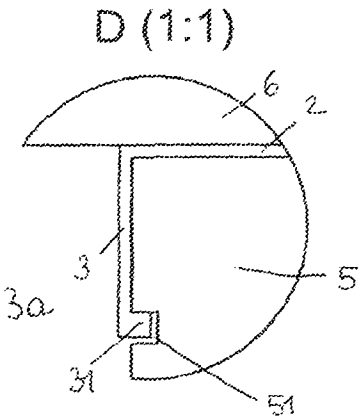
FIG. 3*a* shows a detail view of the clip clamp of FIG. 3.

How the board 6 is placed and secured with its lateral grooves 61 on the support structure—with otherwise the same reference symbols—is clarified by the side view of a board 6 clipped onto the support beam 5 via its grooves 51 shown in FIG. 3, and by the detail thereof shown in FIG. 3*a*, as well as the sectional view shown in FIGS. 4 and 4*a*, which also show the gap F between adjacent boards 6.

Figure 5:
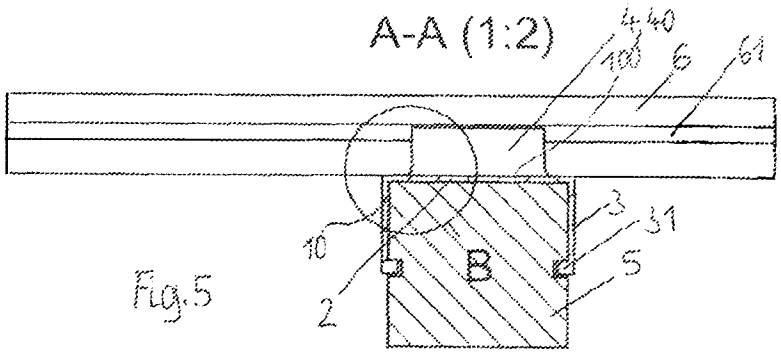
FIG. 5 shows a clip clamp clipped onto the support beam according to an embodiment of the present disclosure.
Figure 5A:
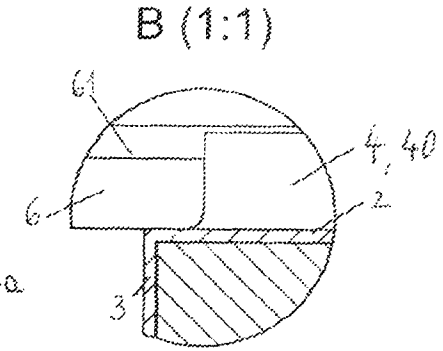
FIG. 5*a* shows a detail of the clip clamp of FIG. 5.
Figure 6:
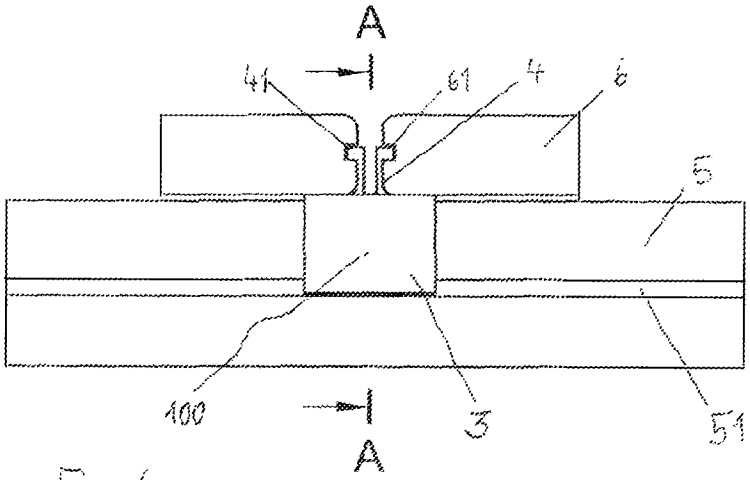
FIG. 6 shows two boards clipped in according to an embodiment of the present disclosure.

FIGS. 5 and 5*a* show—with otherwise the same reference symbols—a board element clipped onto a support beam 5 shown from the side, by means of the squared C-shaped profile 10 of the clip clamp 100, and FIG. 6—likewise with otherwise the same reference symbols—shows a support beam 5 from the side with the board-clamping plates 40 extending transverse thereto—at a right angle in this case—the lips 41 thereof clipped into the lateral grooves 61 of two adjacent boards 6, separated from one another by a gap.

Lastly, FIGS. 7*a* and 7*b* show—with otherwise the same reference symbols—two half-clip clamps 100' according to the present disclosure that are obtained by cutting a clip-clamp 100 according to the present disclosure along the plane of symmetry Sy, with which boards 6 can be securely held in place on the edges of the support structure made of the support beams 5.

The preferred embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

The invention claimed is:

1. A clip clamp for securing boards, each having first longitudinal grooves on each side, without screws or nails, onto support beams, each having second longitudinal grooves on each side, the support beams running at an angle to the boards longitudinally, to form a substructure or support structure, comprising:

a base comprising a squared C-shaped profile and having a middle plate, from which two side plates extend at a right angle from edges of the middle plate;

each of the side plates have a first lip at an end of each side plate, the side plate facing toward one another in a first direction, the first lips being configured to fit into the second longitudinal grooves in the support beams; and two board clamps extending from the middle plate in a second direction that is at an angle to the first direction, each board clamp having a clamping plate, each clamping plate having a second lip facing outward, the second lips facing away from one another, the second lips being configured to fit into the first longitudinal grooves in the boards, characterized in that:

the clip clamp comprises a single piece of an elastic, resilient polymer;

the first lips on the side plates and the second lips on the clamping plates all having a substantially rectangular cross section, and wherein the first lips on the side plates and the second lips on the clamping plates extend at right angles to one another;

wherein the clip clamp is further configured to form a first substantially form-fitting connection with one of the support beams when the clip clamp is pushed onto the support beam by spreading the side plates apart until the first lips on the side plates engage the second longitudinal grooves of the support beam; and wherein the clip clamp is further configured to form a second substantially form-fitting connection with one of the boards to hold the board in place when the board clamps of the clip clamp are bent back to allow the second lip of one of the clamping plates of the clamp to engage the first longitudinal groove on a side of one of the boards and when the board clamps of a second, identical clip clamp on an adjacent support beam are bent back to allow the second lip of one of the clamping plates of the second clip clamp to engage the first longitudinal groove on an opposite side of the board.

2. The clip clamp according to claim 1, characterized in that the board clamps at a spacing to one another of at least 3 mm.

3. The clip clamp according to claim 1, characterized in that a space between the board clamps at a lower region between the board clamps is squared off or has a V-shape.

4. The clip clamp according to claim 1, characterized in that an edge of each of the first lips of the side plates is rounded.

5. The clip clamp according to claim 1, characterized in that at least one of a lower edges and an upper edge of each of the second lips of the board clamps is rounded.

6. The clip clamp according to claim 1, characterized in that a half-clip clamp for securing the boards on both side edges of the flat structure is obtained by smoothly cutting the clip clamp in half along a plane of symmetry parallel to the clamping plates.

7. A flat structure in which a plurality of support beams having longitudinal grooves along each side form a substructure or support structure and are configured to support a plurality of boards also having first longitudinal grooves along each side, wherein the support beams and boards are connected with one another with a plurality of clip clamps according to claim 1.

8. A flat structure according to claim 7, characterized in that the middle plate of each clip clamp is in the shape of a rectangle or parallelogram.

9. The flat structure according claim 7, characterized in that the board clamps of each clip clamp are at a spacing to one another of at least 3 mm.

10. The flat structure according to claim 7, characterized in that at a lower region between the board clamps on each of the clip clamps at a spacing to one another therein is squared off or V-shaped.

11. The flat structure according to claim 7, characterized in that an edge of each of the first lips of the side plates of each clip clamp is rounded.

12. The flat structure according to claim 7, characterized in that at least one of a lower edge and an upper edge of each of the second lips of the board clamps of each clip clamp is rounded.

13. The flat structure according to claim 7, characterized in that at least a lower longitudinal edges of each of the boards facing the support structure is rounded.

14. A method for building a flat structure according to claim 7, characterized in that:

when placing each board on the support beams, a first clip clamp is pushed onto one of the support beams by spreading the side plates apart, until the first lips of the side plates snap in place in the second longitudinal grooves on each side of the support beam in a substantially form-fitting connection; and after this, bending back the board clamps of the first clip clamp to allow the second lip of one of the clamping plates to engage the first longitudinal groove on one side of one of the board, and bending back the board clamps of a second, identical clip clamp on an adjacent support beam to allow the second lip of one of the clamping clips of the second clip clamp to engage the first longitudinal groove on an opposite side of the board to form a substantially form-fitting connection to the board and hold the board in place.

15. The clip clamp according to claim 1, wherein the elastic, resilient polymer is polyethylene terephthalate.

* * * * *